US008684013B2

(12) United States Patent
Haman et al.

(10) Patent No.: US 8,684,013 B2
(45) Date of Patent: Apr. 1, 2014

(54) EYE MAKEUP FALLOUT PROTECTOR

(76) Inventors: Denise I. Haman, San Leandro, CA (US); Thomas R. Ranftl, San Leandro, CA (US); Robert W. Ranftl, Rolling Hills Estates, CA (US)

( * ) Notice: Subject to any disclaimer, the term of this patent is extended or adjusted under 35 U.S.C. 154(b) by 0 days.

(21) Appl. No.: 13/351,785

(22) Filed: Jan. 17, 2012

(65) Prior Publication Data

US 2012/0266911 A1 Oct. 25, 2012

Related U.S. Application Data

(60) Provisional application No. 61/461,486, filed on Jan. 19, 2011.

(51) Int. Cl.
*A45D 40/30* (2006.01)

(52) U.S. Cl.
USPC ..... 132/319

(58) Field of Classification Search
USPC ..... 132/319, 320, 216, 285; D28/7
IPC ..... A45D 40/30,29/00
See application file for complete search history.

(56) References Cited

U.S. PATENT DOCUMENTS

| | | | | | |
|---|---|---|---|---|---|
| 1,907,476 | A * | 5/1933 | Ballard et al. | ..... | 132/216 |
| 3,789,856 | A * | 2/1974 | Bomba | ..... | 132/319 |
| 4,807,650 | A * | 2/1989 | Bliss | ..... | 132/319 |
| 5,050,624 | A * | 9/1991 | Kobe et al. | ..... | 132/319 |
| 5,052,417 | A * | 10/1991 | Cordova | ..... | 132/216 |
| 5,178,170 | A * | 1/1993 | Kassai | ..... | 132/319 |
| 5,285,799 | A * | 2/1994 | Minard | ..... | 132/200 |
| 5,311,888 | A * | 5/1994 | Leigh | ..... | 132/319 |
| 5,890,499 | A * | 4/1999 | Fuentes et al. | ..... | 132/319 |
| 5,934,291 | A * | 8/1999 | Andrews | ..... | 132/215 |
| 5,957,142 | A * | 9/1999 | Karafilis | ..... | 132/319 |
| 6,026,824 | A * | 2/2000 | Gueret | ..... | 132/218 |
| 6,199,560 | B1 * | 3/2001 | North et al. | ..... | 132/319 |
| 6,305,389 | B1 * | 10/2001 | Bakken | ..... | 132/319 |
| 6,640,814 | B1 * | 11/2003 | Burke | ..... | 132/319 |
| 8,141,564 | B2 * | 3/2012 | Cassese | ..... | 132/319 |
| 2002/0124865 | A1 * | 9/2002 | Davis | ..... | 132/319 |
| 2003/0094184 | A1 * | 5/2003 | Parsons | ..... | 132/319 |
| 2004/0089319 | A1 * | 5/2004 | Thayer | ..... | 132/319 |
| 2004/0255971 | A1 * | 12/2004 | Houghton | ..... | 132/319 |
| 2005/0022838 | A1 * | 2/2005 | Davis | ..... | 132/319 |
| 2009/0229622 | A1 * | 9/2009 | Malin et al. | ..... | 132/73.5 |

* cited by examiner

*Primary Examiner* — Robyn Doan
*Assistant Examiner* — Tatiana Nobrega
(74) *Attorney, Agent, or Firm* — Roy A. Ekstrand

(57) ABSTRACT

An eye makeup fallout protector for use in shielding the user's face beneath the eye during the application of eye makeup includes a planar flexible shield member and supporting handle. The shield member is curved to conform generally to the user's lower eyelid. The handle is removable to facilitate cleaning and replacement of the shield member.

13 Claims, 5 Drawing Sheets

EYE MAKEUP FALLOUT PROTECTOR

CROSS-REFERENCE TO RELATED APPLICATIONS

This application claims priority under 35 U.S.C. 119(e) of Provisional Patent Application Ser. No. 61/461,486 filed Jan. 19, 2011 on behalf of Denise I. Haman, Thomas R. Ranftl and Robert W. Ranftl entitled EYE MAKEUP FALLOUT PROTECTOR, which is hereby incorporated herein by reference.

FIELD OF THE INVENTION

This invention relates generally to eye makeup application and particularly to improved apparatus for preventing eye makeup fallout onto facial skin beneath the eye during the makeup application process.

BACKGROUND OF THE INVENTION

The application of facial makeup is a long-standing and well-known custom and process in the art. Through the years a variety of materials and styles as well as application processes for applying eye makeup have been employed. Most modern facial makeup materials and processes utilized one or more general facial area makeup materials together with several additional materials known in the art collectively as "eye makeup". General facial material makeup is applied to relatively large skin areas including the skin area beneath the user's eyes. Eye makeup is typically applied to the user's eyelashes, eyelids, eyebrows, upper and lower eye region.

One of the more vexing problems often encountered during the application of eye makeup arises due to the powered or particulate character of many eye makeup materials. As this powdered or particulate material is applied a portion of the eye makeup material tends to fall downwardly upon the facial skin areas beneath the user's eyes. This problem is exacerbated by the dark and vivid colors which characterize most eye makeup contrasted with the subtle more generally neutral colors of the skin surface makeup applied to facial areas beneath the eye. Thus, even a small amount of eye makeup powder or particulate falling upon the skin beneath the user's eye can discolor the skin and can prove to be difficult to remove or cover.

Recognizing the problems associated with eye makeup fallout during application, practitioners in the art have endeavored to provide various protective shields which are intended to cover and protect the facial skin beneath the eye during eye makeup application. Unfortunately, many of the prior art makeup shields provided are fabricated of a disposable material temporarily attached to the user's skin beneath the eye utilizing various adhesives. Such devices have proven to be subject to several problems and limitations and have, for the most part, proven to be generally unsatisfactory. Typically, adhesive attachment of such shields proves to be awkward and uncomfortable for the user. In addition, the adhesive attachment adherence to the user's skin often results in pulling the user's skin during protective shield removal. This pulling stretches the user's skin and often damages the applied makeup. In addition to problems of discomfort and skin pulling caused by adhesive attachment, the adhesive materials themselves often prove to be undesirable due to sensitivity of many users to the adhesive material and in some instances actual allergy problems arises. Further limitation in the practicality of such disposable adhesively attached protective makeup shields arises in the economics of their use.

Because such shields are disposable and intended for single use, they often prove to be costly and uneconomical for the user.

In a related art, U.S. Pat. No. 6,640,814 issued to Burke sets forth a MASCARA APPLICATION SHIELD AND HAND-HELD SHIELD HOLDER for aiding in the application of mascara to the user's lower eyelash. The shield holder described therein includes a manually-engageable handle on its lower end and a spoon-shaped panel on its upper end. It is curved from top to bottom. The shield holder releasibly holds a mascara shield made of soft, flexible sheet material provided with repositionable pressure-sensitive adhesive. The mascara shield is held under the eyelashes when mascara is being applied to avoid deposit of the mascara on the skin below the eyes. The handle is long enough and curved enough to hold the shield in place when it is positioned by hand, without interfering with the mascara-applying hand.

While the foregoing described prior art devices have provided some benefit to the user, they remain subject to several limitations and problems. Accordingly, there remains a continuing and unresolved need in art for an improved method and apparatus for dealing with eye makeup fallout during the makeup application process.

SUMMARY OF THE INVENTION

The present invention overcomes the problems and limitations to which the prior art makeup shields have been subject by providing a generally planar flexible fallout shield formed of a flexible non-allergic material such as silicone rubber or the like which is configured for placement beneath the user's eye overlying and protecting the facial skin beneath the eye. The inventive shield defines an upper surface textured and/or contoured to retain and hold eye makeup material which falls upon the shield during makeup application. The inventive shield is configured to be easily held during makeup application and to avoid the need for adhesive attachment. The device is washable and reusable to improve the economy of use. The inventive device includes a handle for ease of use.

In accordance with the present invention, there is provided an eye makeup fallout protector for use in covering a portion of the user's face beneath the user's eye, the eye makeup fallout protector comprising: a generally planar shield member formed of a soft resilient material, defining an upper portion, a lower portion, opposed side edges, a fallout receiving surface and a concave curved upper edge forming an upper edge of the upper portion; a handle having a grip portion; and attachment means for joining the handle and the shield member.

In accordance with a further aspect of the present invention, there is provided an eye makeup fallout protector for use in covering a portion of the user's face beneath the user's eye, the eye makeup fallout protector comprising: a generally planar shield member formed of a soft resilient material, defining an upper portion, a lower portion, opposed side edges, a fallout receiving surface and a concave curved upper edge forming an upper edge of the upper portion; a handle having a grip portion; and attachment means for joining the handle and the shield member, the shield member being either uniform thickness or, alternatively, having a tapered thickness defining a reduced thickness proximate the concave curved edge and an increasing thickness as the distance from the concave curved edge increases.

In accordance with a still further aspect of the present invention, there is provided an eye makeup fallout protector for use in covering a portion of the user's face beneath the user's eye, the eye makeup fallout protector comprising: a generally planar shield member which may be uniform in thickness or tapered is formed of a soft resilient material, defining an upper portion, a lower portion, opposed side edges, a fallout receiving surface and a concave curved upper edge forming an upper edge of the upper portion; and a handle having an elongated grip portion joined to the lower portion of the shield member. The shield member and the handle being integrally formed to define a single integral structure having either a uniform thickness or tapered thickness. A taper provides a reduced thickness proximate the concave curved edge and an increased thickness at the handle.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

By way of overview, the present invention provides a flexible generally planar shield preferably formed of a silicone rubber material or the like which is non-allergenic and appropriate for use in proximity to the human eye. The flexible planar shield defines a curved upper edge suitable for positioning the shield near the bottom portion of the user's eye. A supporting handle is joined to the flexible planar shield and is configured to be easily held by the user. In its preferred form, the planar shield portion defines a textured upper surface having a plurality of ribs configured to cooperate with the textured surface in catching and retaining powder and particulate eye makeup material falling thereon. The silicone rubber material of the planar shield facilitates the easy cleaning and reuse of the device. In its preferred fabrication, the planar shield and handle define elements of a cooperating removable attachment which facilitates the separation of the planar shield member from the handle during the cleaning process. In alternate embodiments of the invention, the handle is integrally formed with the planar shield member while in other embodiments, the handle is removed and the shield is gripped using the attachment snaps on the shield.

Figure 1:
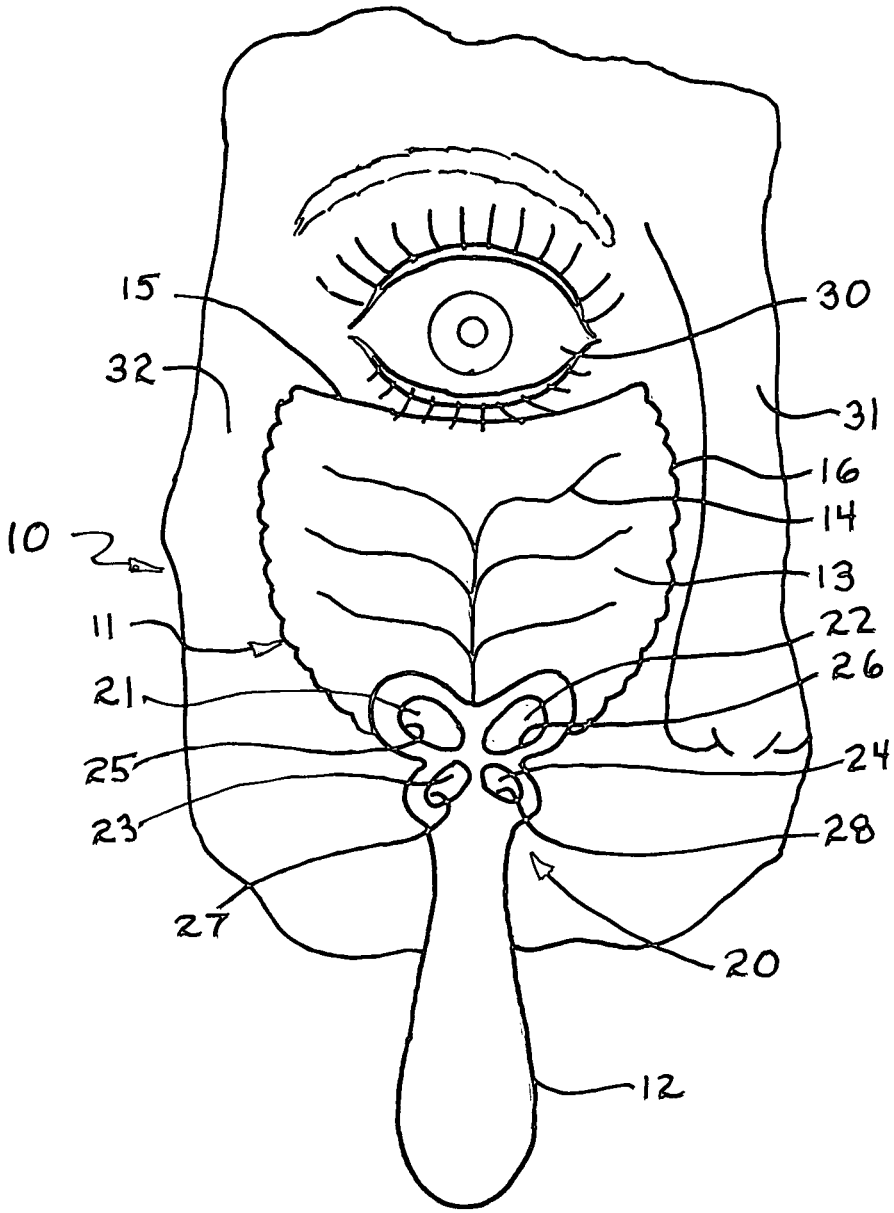
FIG. 1 sets forth a front view of an exemplary use of the present invention eye makeup fallout protector.

More specifically, FIG. 1 sets forth a front view of the present invention eye makeup fallout protector positioned beneath the eye of a typical user in the intended use of the present invention protector. Accordingly, a protector constructed in accordance with the present invention and generally referenced by numeral 10 includes a flexible generally planar shield member 11 having a curved upper edge 15 together with a textured or fluted edge 16. Protector 10 further includes a handle 12 configured to be readily gripped by the user secured to planar shield member 11 by an attachment generally referenced by numeral 20. The structure of attachment 20 is set forth below in FIGS. 2 and 3 in greater detail. However, suffice it note here that attachment 20 provides a removable attachment between planar shield member 11 and handle 12 utilizing a plurality of resilient snaps 21 through 24 extending from planar shield member 11 together with a plurality of cooperating apertures 25 through 28 formed in the upper portion of handle 12. The snap fit attachment of snaps 21 through 24 within apertures 25 through 28 facilitates the easy removal and reattachment of planar shield 11. In an alternate use, planar shield 11 may be gripped without the use of handle 12 by grasping resilient snaps 21 through 24 directly.

In the typical use shown in FIG. 1, a user eye 30 and nose 31 are shown in relative position upon a face 32 of a typical user. In accordance with the present invention, protector 10 is positioned upon facial area 32 of the user beneath the lower edge of eye 30 and alongside nose 31. In this positioning, the curvature of curved edge 15 generally corresponds to the lower curved edge of eye 30. As the user applies eye makeup to eye 30 the surface provided by planar shield 11 of protector 10 overlies the skin surface beneath eye 30 for protection. As particulate and powder material from eye makeup falls from the region of eye 30 during its application, interposed planar shield member 11 catches the falling particulate and powder material. In the preferred fabrication of the present invention, planar shield member 11 defines a textured surface 13 upon which a plurality of raised ribs 14 are formed. The pattern of raised ribs 14 together with the texture of surface 13 cooperate to maintain fallen powder and particulate eye makeup material upon surface 13 thereby protecting the user's facial skin areas from eye makeup. In the embodiment shown in FIG. 1, ribs 14 are formed in a pattern generally resembling the vein structure of a leaf. However, it will be apparent to those skilled in the art from the alternate embodiments described below that different rib patterns and textured surface combinations may be utilized without departing from the spirit and scope of the present invention.

In further accordance with advantages of the present invention, protector 10 may then be removed from the user's facial area and may be washed or shaken to remove accumulated eye makeup powder and particulate material. Attachment 20 facilitates the complete removal of planar shield member 11 from handle 12 to provide a more through washing or cleaning as desired.

Figure 2:
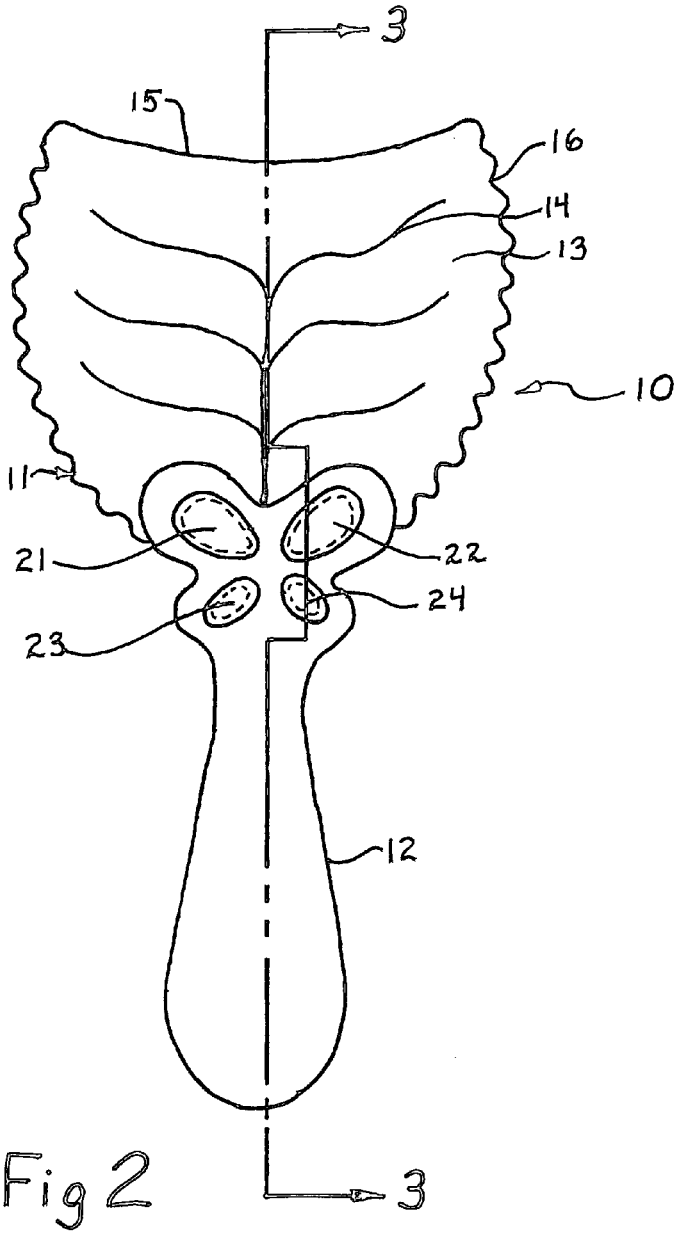
FIG. 2 sets forth a detailed front view of the present invention eye makeup fallout protector.

FIG. 2 sets forth a front view of eye makeup fallout protector 10. As described above, protector 10 includes a flexible generally planar shield member 11 defining a curved upper edge 15 and a fluted edge 16. As is also described above, protector 10 includes a handle 12 secured to planar shield member 11 in a removable attachment 20. Planar shield member 11 defines a fallout receiving textured surface 13 upon which a plurality of raised ribs 14 are formed. Planar shield 11 defines a plurality of resilient snaps 21 through 24. Correspondingly, handle 12 defines a plurality of apertures 25 through 28 (seen in FIG. 4) positioned in registration with snaps 21 through 24. As is better seen below in FIGS. 3 and 4, snaps 21 through 24 define respective extending resilient lip portions 41 through 44 which are slightly larger than the corresponding cooperating apertures 25 through 28. In this manner snaps 21 through 24 are received within and forced through apertures 25 through 28 during attachment of planar shield member 11. During removal the resilience of snaps 21 through 24 allow snaps 21 through 24 to be removed from apertures 25 through 28 releasing handle 12 from shield member 11. It will be apparent to those skilled in the art that differently shaped and number of snaps may be used without departing from the spirit and scope of the present invention.

Figure 3:
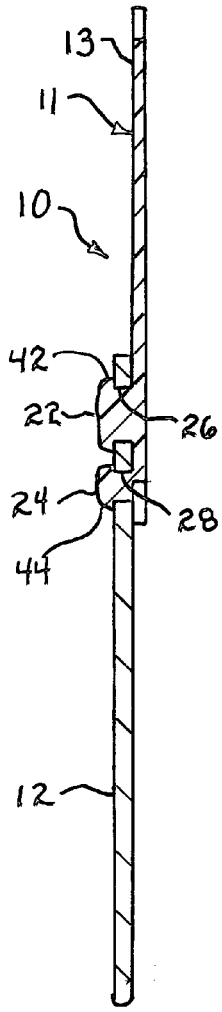
FIG. 3 sets forth a section view of the present invention eye makeup fallout protector taken along section lines 3-3 in FIG. 2.

FIG. 3 sets forth a section view protector 10 taken along section lines 3-3 in FIG. 2. Of particular interest in the section view of FIG. 3 is the detailed structure of attachment 20 which, as mentioned above, provides removable attachment between shield member 11 and handle 12.

More specifically, protector 10 includes a flexible generally planar shield member 11 defining a textured surface 13 which in turn defines a plurality of raised ribs 14. Protector 10 further includes a handle 12 which defines a plurality of apertures including apertures 26 and 28. As is also described above, planar member 11 defines a plurality of resilient snaps such as snaps 22 and 24. As is better seen in FIG. 4, snap 22 defines an extending resilient lip 42 while snap 24 defines an extending resilient lip 44. As is also better seen in FIG. 4, snaps 21 and 23 define similar extending resilient lips 41 and 43 respectively. In the attachment shown in FIG. 3, snaps 22 and 24 are forced through apertures 26 and 28 respectively such that resilient lips 41 and 42 are forced through apertures 26 and 28 after which they resume their extending shape and secure handle 12 to shield member 11. The flexibility of shield member 11 and snaps 21 through 24 facilitates this snap fit attachment. However, it will be apparent to those skilled in the art from the descriptions that follow that other attachment apparatus may be utilized to provide a removable handle and planar shield member without departing from the spirit and scope of the present invention. It will be further apparent to those skilled in the art from the descriptions which follow that handle 12 may be integrally formed with shield member 11 without departing from the spirit and scope of the present invention.

Figure 4:
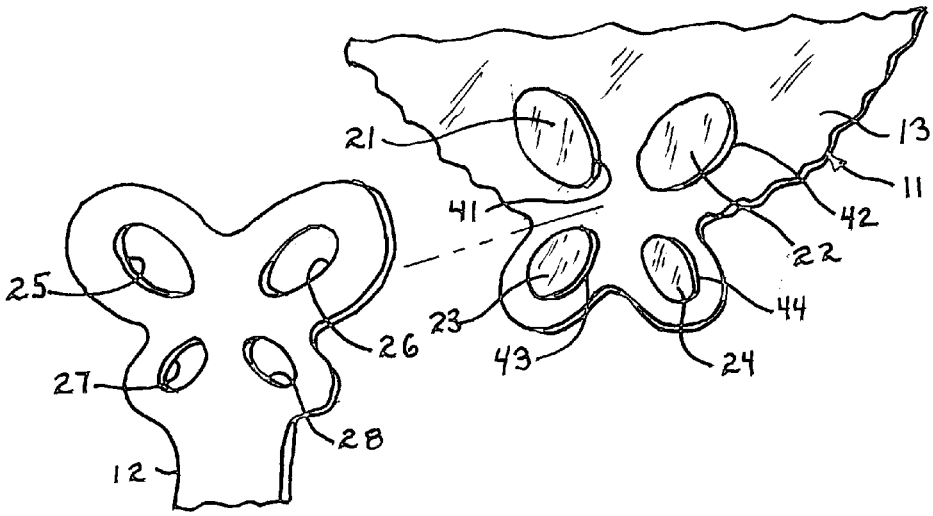
FIG. 4 sets forth a partial prospective assembly view of the present invention eye makeup fallout protector.

FIG. 4 sets forth a partial prospective assembly view of handle 12 and shield member 11 illustrating the components forming attachment 20. Thus, as described above, flexible generally planar shield member 11 defines a plurality of resilient snaps 21 through 24 each having resilient extending lips 41 through 44 respectively. As is also described above, handle 12 defines a plurality of apertures 25 through 28 configured in registration with snaps 21 through 24. In the position shown in FIG. 4, handle 12 and generally planar shield member 11 are shown separated and aligned for attachment. Attachment is carried forward by placing apertures 25 through 28 in alignment with snaps 21 through 24 and thereafter forcing snaps 21 through 24 through their respective ones of apertures 25 through 28. Removal is accomplished in the reverse fashion by simply peeling shield member 11 away from handle 12 withdrawing snaps 21 through 24 from apertures 25 through 28.

Figure 5:
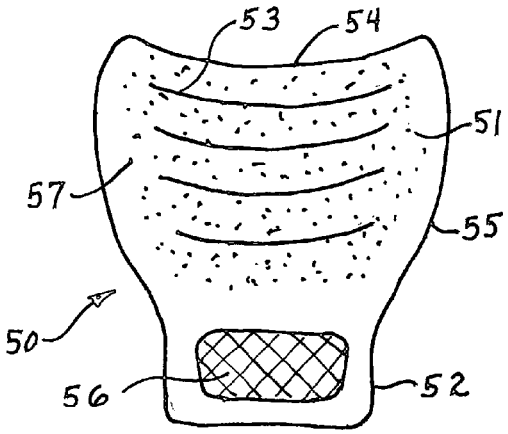
FIG. 5 sets forth a front view of an alternate embodiment of the present invention eye makeup fallout protector.

FIG. 5 sets forth a front view of an alternate embodiment of the present invention generally referenced by numeral 50. Protector 50 includes a flexible generally planar shield 51 defining a curved edge 54 and an integrally formed handle 52. Shield portion 51 defines smooth outer edges 55 on either side thereof together with a textured surface 57 which in turn defines a plurality of raised ribs 53. For convenience a grip surface 56 is provided on integrally formed handle portion 52.

Figure 6:
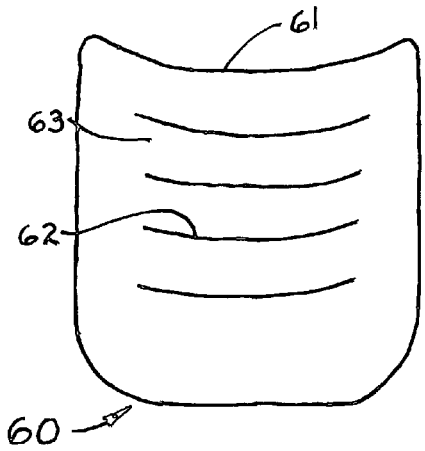
FIG. 6 sets forth a front view of a further alternate embodiment of the present invention eye makeup fallout protector.

FIG. 6 sets forth a front view of a further alternate embodiment of the present invention protector generally referenced by numeral 60. Protector 60 is preferably formed of a generally planar flexible silicone rubber material or the like and defines a curved edge 61. Protector 60 further defines a surface 63 upon which a plurality of raised ribs 62 are formed. In the anticipated use of protector 60, the user simply grips the lower portion of protector 60 and positions the protector in the manner illustrated above in FIG. 1.

Figure 7:
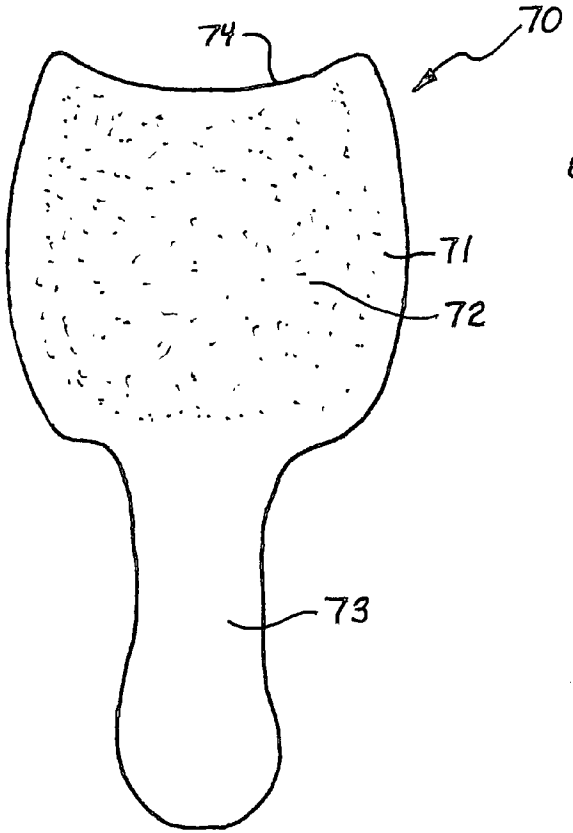
FIG. 7 sets forth a front view of a still further alternate embodiment of the present invention eye makeup fallout protector.

FIG. 7 sets forth a front view of a still further alternate embodiment of the present invention protector generally referenced by numeral 70. Protector 70 includes a generally planar flexible shield member 71 defining a texture 72 and a curved edge 74. Texture 72 is selected to provide adherence of falling powder and particulate eye makeup material. It will be noted that FIG. 7 also shows a protector in accordance with the present invention which utilizes a more extreme textured surface to function without the need for raised rib portions as described in the embodiments above. It will be apparent to those skilled in the art that each of the embodiments of the present invention set forth herein may utilize either a textured surface, a plurality of raised ribs or a combination of textured surface and raised ribs without departing from the spirit and scope of the present invention. Protector 70 further includes an integrally formed handle 73 extending downwardly and configured suitable grip by the user.

Figure 8:
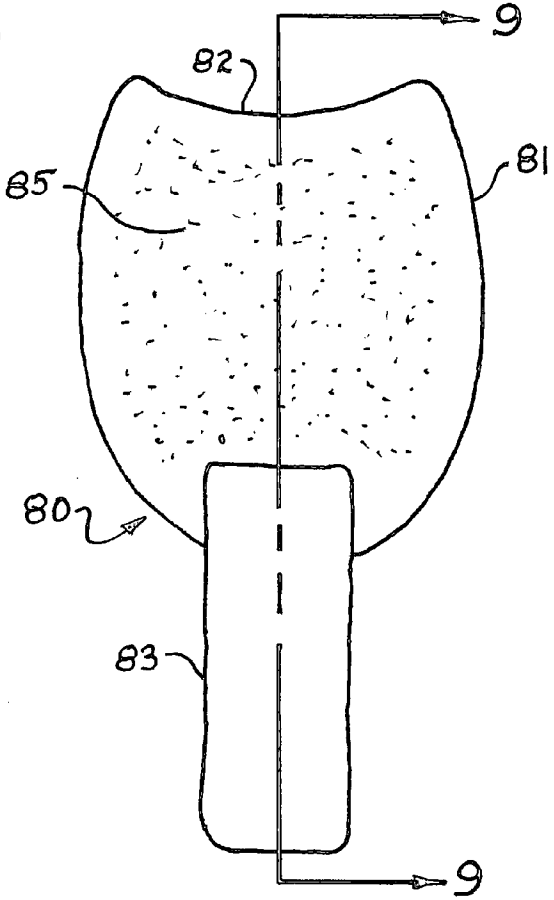
FIG. 8 sets forth a front view of a still further alternate embodiment of the present invention eye makeup fallout protector.

FIG. 8 sets forth a front view of a still further alternate embodiment of the present invention protector generally referenced by numeral 80. Protector 80 includes a flexible generally planar shield 81 defining a curved edge 82 and a textured surface 85. Protector 80 further includes a handle 83 which, as is better seen in FIG. 9, is snap-fit assembled to planar shield member 81 using a receiving slot 84 defined in handle 83.

Figure 9:
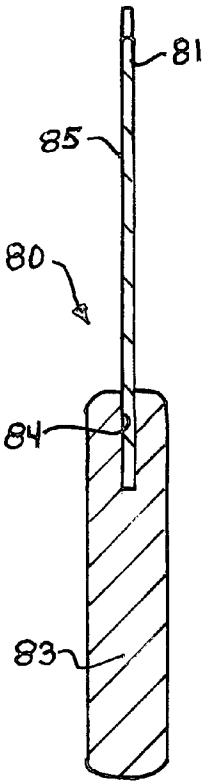
FIG. 9 sets forth a section view of the embodiment of FIG. 8 taken along section lines 9-9 therein.

FIG. 9 sets forth a section view of protector 80 taken along section lines 9-9 in FIG. 8. As previously described, protector 80 includes a flexible generally planar shield member 81 having a curved edge 82. As is also described, protector 80 includes a handle 83 defining a slot 84 in the upper portion thereof. Attachment of planar shield 81 is facilitated by inserting planar shield 81 into slot 84 in a snug attachment. The size of slot 84 is selected to providing sliding but firm attachment between handle 83 and planar shield member 81. This attachment provides for removal of planar shield 81 to facilitate washing and cleaning.

Figure 10:
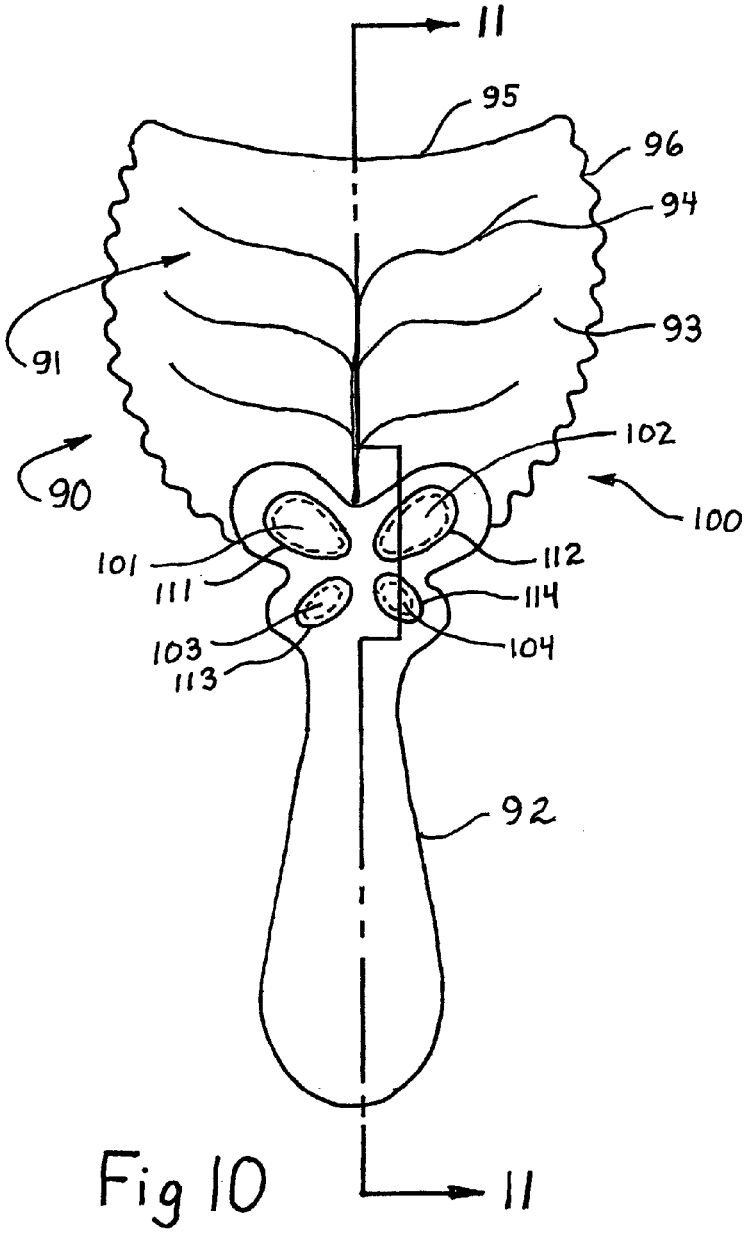
FIG. 10 sets forth a front view of an alternate embodiment of the present invention eye makeup fallout protector having a tapered planar shield member.
Figure 11:
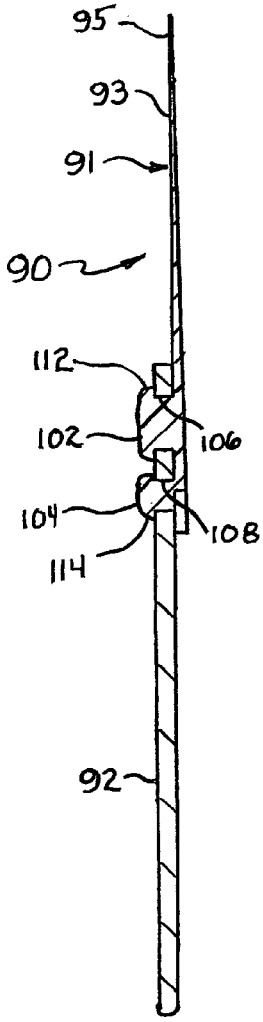
FIG. 11 sets forth a section view of the alternate embodiment of the present invention shown in FIG. 10 taken along section lines 11-11 therein.

FIGS. 10 and 11 set forth a further alternate embodiment of the present invention which is identical to protector 10 shown above except for the taper of shield member 91 (seen best in FIG. 11). P FIG. 10 sets forth a front view of eye makeup fallout protector 90. As described above for protector 10, protector 90 includes a flexible generally planar shield member 91 defining a curved upper edge 95 and a fluted edge 96. In a structure similar to protector 10, protector 90 includes a handle 92 secured to planar shield member 91 in a removable attachment 100. Planar shield member 91 defines a fallout receiving textured surface 93 upon which a plurality of raised ribs 94 are formed. Planar shield 91 defines a plurality of resilient snaps 101 through 104. Correspondingly, handle 92 defines a plurality of apertures identical to apertures 25 through 28 seen in FIG. 4 positioned in registration with snaps 101 through 104. Snaps 101 through 104 define respective extending resilient lip portions 111 through 114 which are slightly larger than their corresponding cooperating apertures. In this manner snaps 101 through 104 are received within and forced through their respective apertures during attachment of planar shield member 91. During removal the resilience of lip portions 111 through 114 allow snaps 101 through 104 to be removed from their respective apertures releasing handle 92 from shield member 91.

FIG. 11 sets forth a section view protector 10 taken along section lines 11-11 in FIG. 10. Of particular interest in the section view of FIG. 11 is the detailed structure of attachment 100 which, as mentioned above, provides removable attachment between shield member 91 and handle 92. Also, of special interest in FIG. 11 is the tapered thickness of shield member 91 which provides a thinner edge 95 and greater flexibility proximate edge 95.

More specifically, protector 90 includes a flexible generally planar shield member 91 defining a textured surface 93 which in turn defines a plurality of raised ribs 94. Protector 90 further includes a handle 92 which defines a plurality of apertures including apertures 106 and 108. Planar member 91 also defines a plurality of resilient snaps such as snaps 102 and 104. Snap 104 defines an extending resilient lip 111 while snap 104 defines an extending resilient lip 114. While not seen in FIG. 11, it will be understood that snaps 101 and 103 define similar extending resilient lips. In the attachment shown in FIG. 11, snaps 102 and 104 are forced through apertures 106 and 108 respectively such that resilient lips 111 and 112 are forced through apertures 106 and 108 after which they resume their extending shape and secure handle 92 to shield member 91. The flexibility of shield member 91 and snaps 101 through 104 facilitates this snap fit attachment. However, it will be apparent to those skilled in the art that other attachment apparatus may be utilized to provide a removable handle and planar shield member without departing from the spirit and scope of the present invention. It will be further apparent to those skilled in the art that handle 92 may be integrally formed with shield member 91 without departing from the spirit and scope of the present invention.

What has been shown is an eye makeup fallout protector which utilizes a silicone rubber material or the like to provide a flexible protector during the application of eye makeup. The protector includes a generally planar flexible shield member which may be conveniently washed and cleaned between applications of eye makeup. The inventive eye makeup fallout protector shown avoids the undesirable use of adhesives for skin attachment. In addition, the present invention eye makeup fallout protector is easy to clean and reusable. A variety of textures and raised rib patterns are provided upon the flexible planar shield member to facilitate catching of falling particulate and powder eye makeup material. In some embodiments the handle is removable from the planar shield member for easy cleaning. It has been found that while a variety of materials may be utilized to form the flexible shield member of the present invention, silicone rubber material has shown considerable advantage and attractiveness.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An eye makeup fallout protector for use in covering a protected portion of the user's face extending from beneath the user's eye downwardly across the user's entire cheek, said eye makeup fallout protector comprising:

a generally flat flexible planar shield member formed of a soft resilient material, defining an upper portion, a lower portion, opposed serrated side edges each extending from said upper portion to said lower portion, a fallout receiving surface, defining a plurality of raised ribs to catch and retain eye makeup particles, and a concave curved upper edge forming an upper edge of said upper portion, said shield member defining a single integral member having a continuous length extending from said upper edge to said lower portion a sufficient distance to cover the protected portion of a user's face including a user's entire cheek when said eye makeup fallout protector is placed with said curved upper edge beneath a user's eye;

a handle having a grip portion; and attachment means formed of resilient material for joining said handle and said shield member in a removable attachment.

2. The eye makeup fallout protector set forth in claim 1 wherein said attachment means provides a removable attachment of said handle and said shield member, said removable attachment including elastic deformation of said attachment means.

3. The eye makeup fallout protector set forth in claim 2 wherein said fallout receiving surface defines a surface texture.

4. The eye makeup fallout protector set forth in claim 3 wherein said attachment means includes a plurality of cooperating resilient snap-fit attachment members formed on said lower portion of said shield member and a plurality of rigid attachment members formed on said handle.

5. The eye makeup fallout protector set forth in claim 4 wherein said cooperating snap-fit attachment members include:

a plurality of resilient snaps each having a body extending upwardly from said shield member and an enlarged lip extending outwardly from said body; and a plurality of apertures sized and shaped smaller than said enlarged lips to receive said snaps in a forced fit.

6. The eye makeup fallout protector set forth in claim 2 wherein said attachment means includes:

a slot formed in said handle; and an insertable portion of said lower portion of said shield member, said insertable portion being inserted into said slot in an interference fit.

7. An eye makeup fallout protector for use in covering a protected portion of the user's face extending from beneath the user's eye downwardly across the user's entire cheek, said eye makeup fallout protector comprising:

a generally flat flexible planar shield member formed of a soft resilient material, defining an upper portion, a lower portion, opposed serrated side edges each extending from said upper portion to said lower portion, a fallout receiving surface, defining a plurality of raised ribs to catch and retain eye makeup particles, and a concave curved upper edge forming an upper edge of said upper portion, said shield member defining a single integral member having a continuous length extending from said upper edge to said lower portion a sufficient distance to cover and conform generally to the protected portion of a user's face including a user's entire cheek when said eye makeup fallout protector is placed with said curved upper edge beneath a user's eye and held against the user's cheek using said handle;

a handle having a grip portion; and attachment means for removably joining said handle and said shield member, said shield member having a tapered thickness defining a reduced thickness proximate said concave curved edge and an increasing thickness as the distance from said concave curved edge increases.

8. The eye makeup fallout protector set forth in claim 7 wherein said fallout receiving surface defines a textured surface.

9. The eye makeup fallout protector set forth in claim 8 wherein said attachment means includes a plurality of cooperating snap-fit attachment members formed on said handle and said lower portion of said shield member.

10. The eye makeup fallout protector set forth in claim 9 wherein said cooperating snap-fit attachment members include:

a plurality of resilient snaps each having a flexible body extending upwardly from said shield member and enlarged resilient lip; and a plurality of apertures smaller than said enlarged lip and sized and shaped to receive said snaps in a forced fit.

11. The eye makeup fallout protector set forth in claim 7 wherein said attachment means includes:

a slot formed in said handle; and an insertable portion of said lower portion of said shield member, said insertable portion being inserted into said slot in an interference fit.

12. An eye makeup fallout protector for use in covering a protected portion of the user's face extending from beneath the user's eye downwardly across the user's entire cheek, said eye makeup fallout protector comprising:

a generally flat flexible planar shield member formed of a soft resilient material, defining an upper portion, a lower portion, opposed serrated side edges each extending from said upper portion to said lower portion, a fallout receiving surface, defining a plurality of raised ribs to catch and retain eye makeup particles, and a concave curved upper edge forming an upper edge of said upper portion, said shield member defining a single integral member having a continuous length extending from said upper edge to said lower portion a sufficient distance to cover the protected portion of a user's face including a user's entire cheek when said eye makeup fallout protector is placed with said curved upper edge beneath a user's eye;

a handle having an elongated grip portion formed on said lower portion of said shield member, said shield member and said handle being integrally formed to define a single integral structure having a reduced thickness proximate said concave curved edge and an increased thickness at said handle.

13. The eye makeup fallout protector set forth in claim 12 wherein said fallout receiving surface defines a textured surface.

* * * * *